US005665015A

United States Patent [19]

Clark, III

[11] Patent Number: 5,665,015

[45] Date of Patent: Sep. 9, 1997

[54] GOLF CLUB SWING TRAINING METHOD

[76] Inventor: James Elwood Clark, III, 31644 Dunn Rd., Denham Springs, La. 70726

[21] Appl. No.: 643,271

[22] Filed: May 3, 1996

[51] Int. Cl.[6] ..... A63B 69/36

[52] U.S. Cl. ..... 473/409; 473/213; 473/215

[58] Field of Search ..... 473/212, 213, 473/215, 409

[56] References Cited

U.S. PATENT DOCUMENTS

| | | | |
|---|---|---|---|
| 3,679,214 | 7/1972 | Boyte | 273/189 |
| 4,337,938 | 7/1982 | Rodriguez | 272/93 |
| 4,691,924 | 9/1987 | Strong | 273/189 |
| 4,892,317 | 1/1990 | Corder, Jr. | 273/183 |
| 5,149,099 | 9/1992 | Radakovich | 273/189 |
| 5,188,365 | 2/1993 | Picard | 273/189 |
| 5,397,122 | 3/1995 | Herridge, II | 273/189 |

FOREIGN PATENT DOCUMENTS

| | | |
|---|---|---|
| 20463 | of 1907 | United Kingdom . |
| 180599 | 8/1921 | United Kingdom . |
| 451516 | 2/1935 | United Kingdom . |

*Primary Examiner*—George J. Marlo

*Attorney, Agent, or Firm*—Roy, Kiesel & Tucker

[57] ABSTRACT

An apparatus to improve a golfer's swing, the golfer having a leading arm and a trailing arm, the golfer's swing having a back swing portion, a downswing portion, and a follow through portion, the apparatus having a chest loop adapted to encircle the chest area of a golfer; a biceps loop connecting to the and adapted to encircle the biceps area of the leading arm of a golfer; and a forearm loop connecting to the chest loop and adapted to encircle the forearm area of the leading arm of a golfer, where the biceps loop and the forearm loop are further adapted to cooperate during a golf swing to restrain the elbow of a golfer's leading arm from detaching during the follow through portion of a golf swing and to have substantially no impact on the golfer's leading arm during the back swing and downswing portion of a golf swing.

18 Claims, 3 Drawing Sheets

GOLF CLUB SWING TRAINING METHOD

BACKGROUND OF THE INVENTION

1. Field of the Invention

This invention relates generally devices for improving a golfer's swing, and more particularly, to devices to help eliminate a golfer's leading arm from detaching during the follow through of a golf swing.

2. Prior Art

The essence of a good golf score is a good golf swing. With a good swing, comes more efficient movement, that is, less energy wasted on unnecessary movement, and more energy focused on proper contact between the golf club head and golf ball. With a good swing comes greater distance and straighter flight to a struck golf ball, characteristics sought by most golfers.

A golf swing can be dissected into distinct parts: (1) the back swing; (2) the downward swing; and (3) the follow through. For sake of discussion, I will consider a right-handed golfer. For a right handed golfer, the left side of the body is considered the leading side (e.g. leading arm, leading shoulder) while the right side of the body is considered the trailing side (e.g. the trailing shoulder, the trailing arm). With this designation, in the back swing, the golfer raises the club over the trailing shoulder, twisting his body clockwise to the trailing side thus storing body energy for the coming downswing, and shifting the golfer's weight to the trailing leg. In the downswing, the club is brought down from the trailing shoulder and into contact with the golf ball. During the downswing, the golfer's body "untwists", transforming the stored body energy into club head speed, and shifts the golfer's weight from the trailing leg to the center of the golfer's body. The follow through portion of the golf swing begins at the point of club-ball contact, and ends with the club raised over the leading shoulder. During the follow through, the golfer's weight is shifted from the center of the golfer's body to the leading leg, the golfer's body twists counterclockwise toward the leading side, and the golfer's wrists "turn over." By "turn over" it is meant the counterclockwise twisting of the wrists which should occur after striking the ball, which results in the turning of the club head face from perpendicular to the ground to facing the ground (the wrists also "turn over" on the downswing, but for the sake of clarity, "turn over" will refer only to the wrist movement occurring on the follow through). Preferably, the travel path of the golfer's arms and golf club during the golf swing remain in a single plane, the desired strike plane.

After the initial ball-club contact, the ball remains in contact with the club head for a short duration of time during the follow through portion of the golf swing. Consequently, the position of the club head face during the follow through portion will have a substantial impact upon the flight of the ball, either straight, slice or hook. The position of the club head face during contact with the ball will also have substantial impact upon spin the ball has coming off the club head, and thus will impact the distance of the ball's travel.

During the follow through, the golfer's leading elbow and leading biceps area should be positioned adjacent to the golfer's leading side, preferably with the leading biceps area in almost continuous contact with the leading chest side of the golfer's body. At the end of the follow through, the leading biceps area will slightly separate from contact with the leading chest side of the golfer's body. Further, the golfer's leading wrist should travel in an upward arc-shaped path in the strike plane and centered on the golfer's chest.

When this leading elbow position and arc path for the leading wrist are established, the golfer's wrist will more readily "turn-over" and the golfer's weight will more readily shift from the center of the golfer's body to the leading leg, resulting in a straighter ball flight path. A common mistake during the follow through is to have the leading arm "detach" from the golfer's body, that is that the leading elbow becomes substantially separated from leading side of the body. This "detachment" (sometimes called a disconnect, or a flying left elbow) usually results in a weak shot as energy is improperly expended: the shifting of the golfer's weight to the leading leg is adversely effected and the wrist fail to turn over, or turn over too late. Furthermore, a poor shot usually results as the ball is generally sliced because the club head face is left open or facing away from the golfer.

Several devices to help improve a golfer's swing have been devised, such as that shown in U.S. Pat. Nos. 5,397,122; 5,188,365; 5,149,099; 4,892,317; 4,691,924; 3,679,215; and British Patents numbers 20,463 and 180,599. Most of these patents employ a series of bands attached to one or both arms in an attempt to restrict the position of the elbows during the golf swing.

For instance, U.S. Pat. No. 5,397,122 shows a device having a waist loop encircling a golfer's waist, with two loops attached thereto, one to encircle the leading biceps area and attached to the leading side of the waist loop, the other to encircle the following biceps area and attached to the following side of the waist loop. This device operated to prevent detachment of the leading arm during the back swing, and of the trailing arm during the follow through.

U.S. Pat. No. 5,188,365 also shows a device having a waist loop encircling a golfer's waist, with two loops attached thereto, one to encircle the leading wrist area and attached to the leading side of the waist loop, the other to encircle the following biceps area and attached to the following side of the waist loop. The loop attached to the leading wrist has a third loop attached thereto, connecting the leading wrist area with the leading knee area. The device primarily is used to prevent the detachment of the following elbow during the back swing and downswing.

U.S. Pat. No. 5,149,099 shows a complex device having a loop circling around the back of a golfer's neck with the front part of the loop held by the golfer's hands, the neck loop is further connected to a second loop encircling the golfers waist or chest. This device apparently functions to assist a golfer's swing by coordinating the relative movements of both arms during the golf swing.

U.S. Pat. No. 3,679,214 also shows a complex device having a series of loops attached to a waist loop, including a trailing shoulder loop, and a trailing forearm loop attached to the leading side of the waist loop. This device is concerned with controlling the trailing elbow during the golf swing.

British Patent 20,463 also shows a waist loop with two elbow loops attached to each other and the waist loop. The two elbow loops are for attaching near a golfer's elbows. This device "ties" both of a golfer's elbows together, so that the separation between the two elbows is maintained during the entire swing, apparently improving a golfer's swing.

Chest loop devices with a single leading arm biceps area loop tethered to the chest loop are shown in U.S. Pat. Nos. 4,892,317; 4,691,924 and British Patent 180,599. These devices try to prevent the detachment of the leading elbow during the follow through by tethering the leading arm biceps area to the golfer's leading side, thus restricting the ability of the leading elbow to move away from the body. However, to keep the leading elbow adjacent to the leading side, the tether must be kept short, thus adversely impacting the movement of the leading arm on the back swing and the downswing. Further, these devices do not guide the leading wrist into an arc-like path during the follow through.

SUMMARY OF THE INVENTION

Therefore, one object of this invention is to provide an apparatus for improving a golfer's follow through swing.

Another object of the invention is to provide an apparatus which allows a golfer to concentrate on improving his back swing and downward stroke.

Another object of the invention is to provide an apparatus for which can be used by left and right hand golfers to improve a golfer's golf swing.

The above objectives are accomplished by providing a device having a chest loop adapted for encircling the chest area of a golfer. Connecting to the chest loop is a biceps loop, adapted to encircle a golfers leading arm biceps area. The biceps loop generally is connected to the waist loop by a leading tether. Also connecting to the chest loop is a forearm loop, which is adapted to encircle the leading arm forearm area. Generally, the biceps loop and forearm loop connect to opposite sides of the waist loop.

DETAILED DESCRIPTION OF THE INVENTION

Figure 1A:
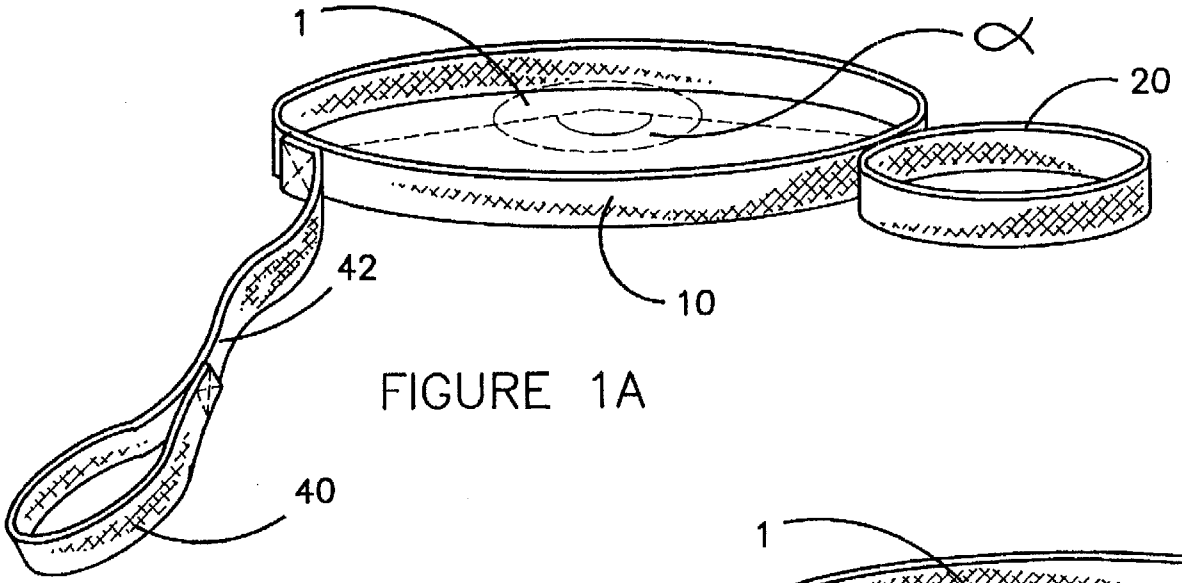
FIG. 1*a* is a perspective of one embodiment of the invention.
Figure 1C:
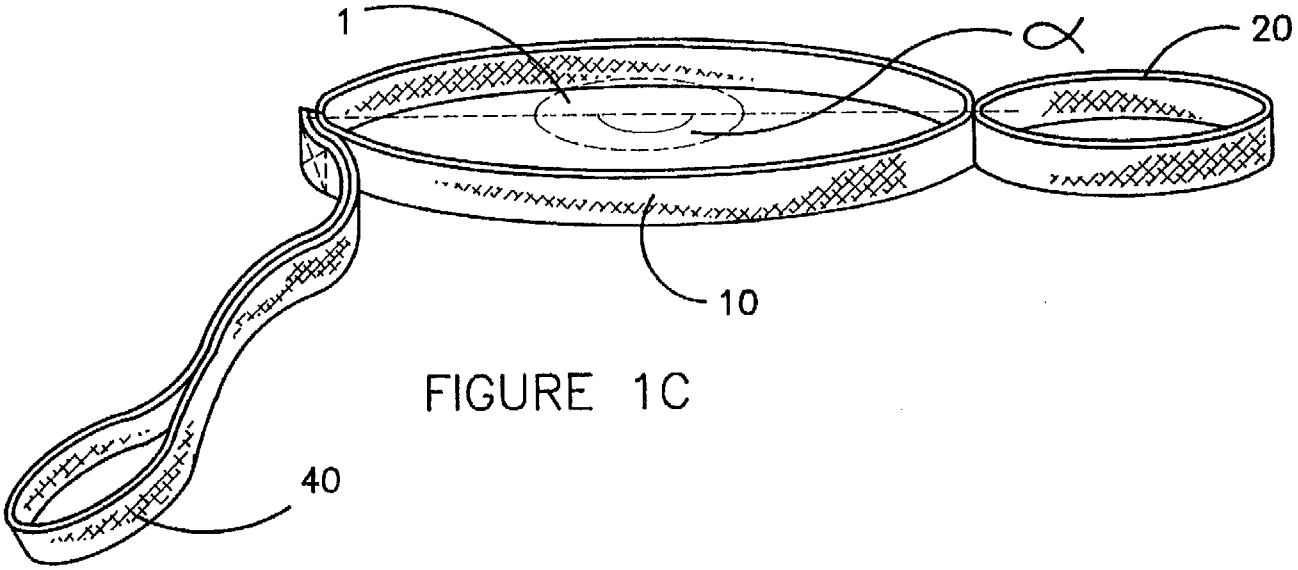
FIG. 1*c* is another embodiment of the invention.
Figure 1B:
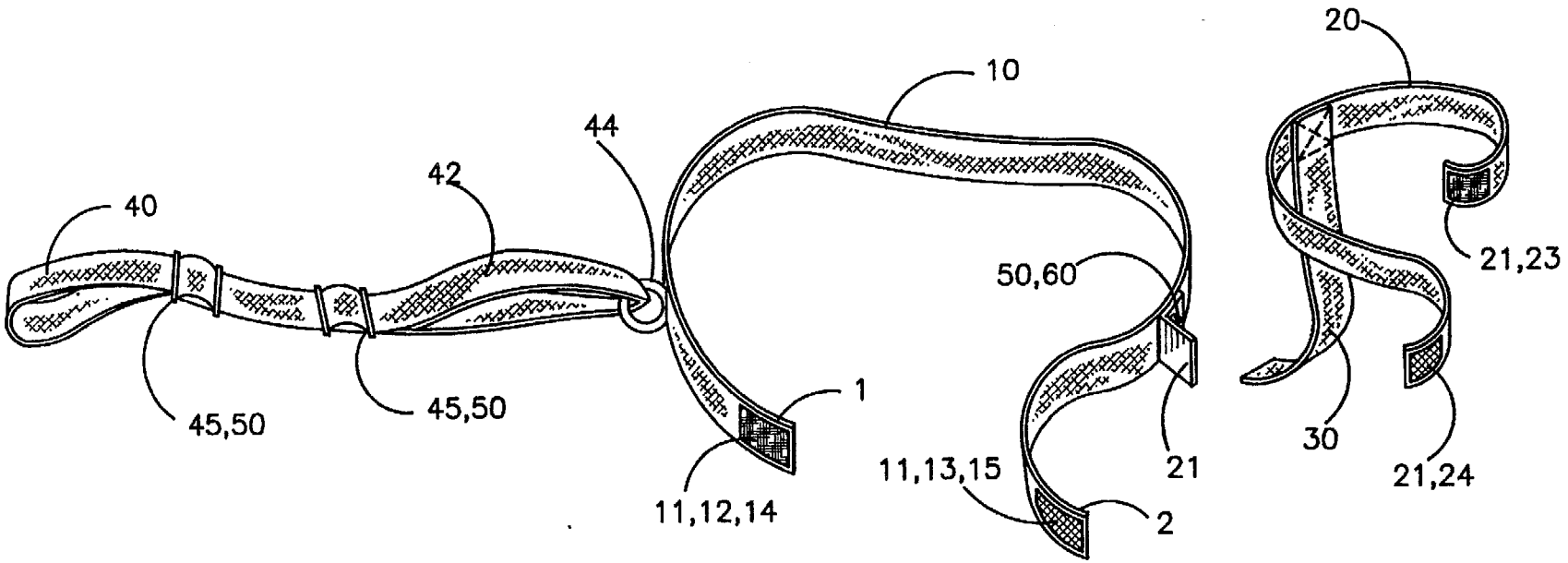
FIG. 1*b* is a perspective of another embodiment of the invention.

FIG. 1*a* shows a embodiment of the present invention. Shown is chest loop 10 sized for encircling the chest area of a golfer. Preferably, the chest loop 10 will encircle the chest near the sternum area. As shown, chest loop 10 is a belt-like strip or band, preferably constructed of an elastic material. Chest loop 10 may be a continuous member, or may have a first end 1 and a second end 2, as shown in FIG. 1*b*. Chest loop 10 may include a chest fitting member 11 for fitting the chest loop 10 to a variety of chest sizes. For instance, chest fitting member 11 could be two D or O shaped rings, or similar structure, attached to the first end 1 of chest loop, though which the second end 2 of the chest loop 10 is threaded through, adjusted to the desired size, and then back threaded through on of the loops and then cinched down. Alternatively, chest fitting member 11 may simply be the ability to tie the two ends of the chest loop 10 together. In another embodiment, chest fitting member 11 may be a first member 12 positioned on the chest loop 10 near the first end 1 and a second member 13 positioned near the second end 2 of the chest loop 10 where the first and second members are matingly engagable and once engaged, are releasable. For instance, first member 12 could be a piece of loop fabric 14 and second member 13 could be a piece of hook fabric 15 placed upon chest loop 10 to form a Velcro-type adjustable fastener, as shown. Alternatively, first member 11 could be a belt buckle, and second member 13 a series of holes near the second end 2. First 12 and second members 13 could be engagable male and female interlocking and releasable clips, or any other type of two piece releasable interlocking device, such as a series of snaps.

Connecting to the chest loop 10 is a biceps loop 20. Biceps loop 20 is sized to encircle a golfer's biceps area on the leading arm, generally that area between the elbow and armpit. Preferably, biceps loop 20 is constructed of an elastic material. Biceps loop 20 may be a continuous band as shown if FIG. 1*a*, or may have two ends as shown in FIG. 1*b*, or a single end. The invention may also have a biceps fitting member 21 for fitting the biceps loop 20 to a variety of biceps area sizes. Clearly, the type of fitting members as described for the chest fitting member 11 could also function as a biceps fitting member 21. Preferably, the biceps fitting member 21 are matingly engagable and releasable pieces of hook 23 and loop 24 fabric, as shown in FIG. 1*b*.

Biceps loop 20 may be directly connected to chest loop 10, or may be attached to chest loop 10 with a biceps tether 30, shown in FIG. 1*b*. Biceps tether 30 can be a single strip or constructed of interconnecting strips of material; preferably the biceps tether 30 is constructed of elastic materials. Biceps tether 30 is generally not necessary if biceps loop 20 is constructed of elastic materials.

Connecting to the chest loop 10 is a forearm loop 40. Forearm loop 40 is sized to encircle a golfer's forearm area on the leading arm, generally that area between the hand and the elbow. Preferably, the forearm loop 40 should attach near the wrist and be constructed of an elastic material. Forearm loop 40 may be a continuous band as shown in FIG. 1*a*, or may have two ends, or a single end (shown in FIG. 1*b*). The invention may also have a forearm fitting member 41 to fit the forearm loop 41 to a variety of forearm area sizes. Clearly, the type of fitting members as described for the chest fitting member 11 could also function as a forearm fitting member 21.

Forearm loop 40 may be directly connected to chest loop 10 as shown in figure, or preferably may be connected to chest loop 10 with a forearm tether 42. Forearm tether 42 can be a single strip or constructed of interconnecting strips of material; preferably the forearm tether 42 is constructed of elastic materials. As shown in FIG. 1B, forearm loop 41 consists of a single band of material connected adjustable by means of slide fastener 43. Forearm tether 42 is an extension of forearm loop 40, and is connected to chest loop 10 by threading through D ring 44 attached to chest loop 10. Forearm tether 42 is adjustable by means of slide fastener 45.

As diagramed in FIG 1*a*, closed chest loop 10 defines a circle 1 having 360 degrees. The connection point of biceps loop 20 and forearm loop 40 with chest loop 10 define an arc on that circle, and the angle subtended by that arc is shown as $\alpha$ in FIG. 1*a*. It is preferable that the subtended angle $\alpha$ be in the range of approximately 90 degrees to approximately 180 degree. It is believed that the device will provide the most benefit when the biceps loop 30 and forearm loop 40 on opposite sides of the circle, that is, when $\alpha$ is approximately 180 degrees as shown in figure.

Figures 2A, 2B, 2C, 2D:
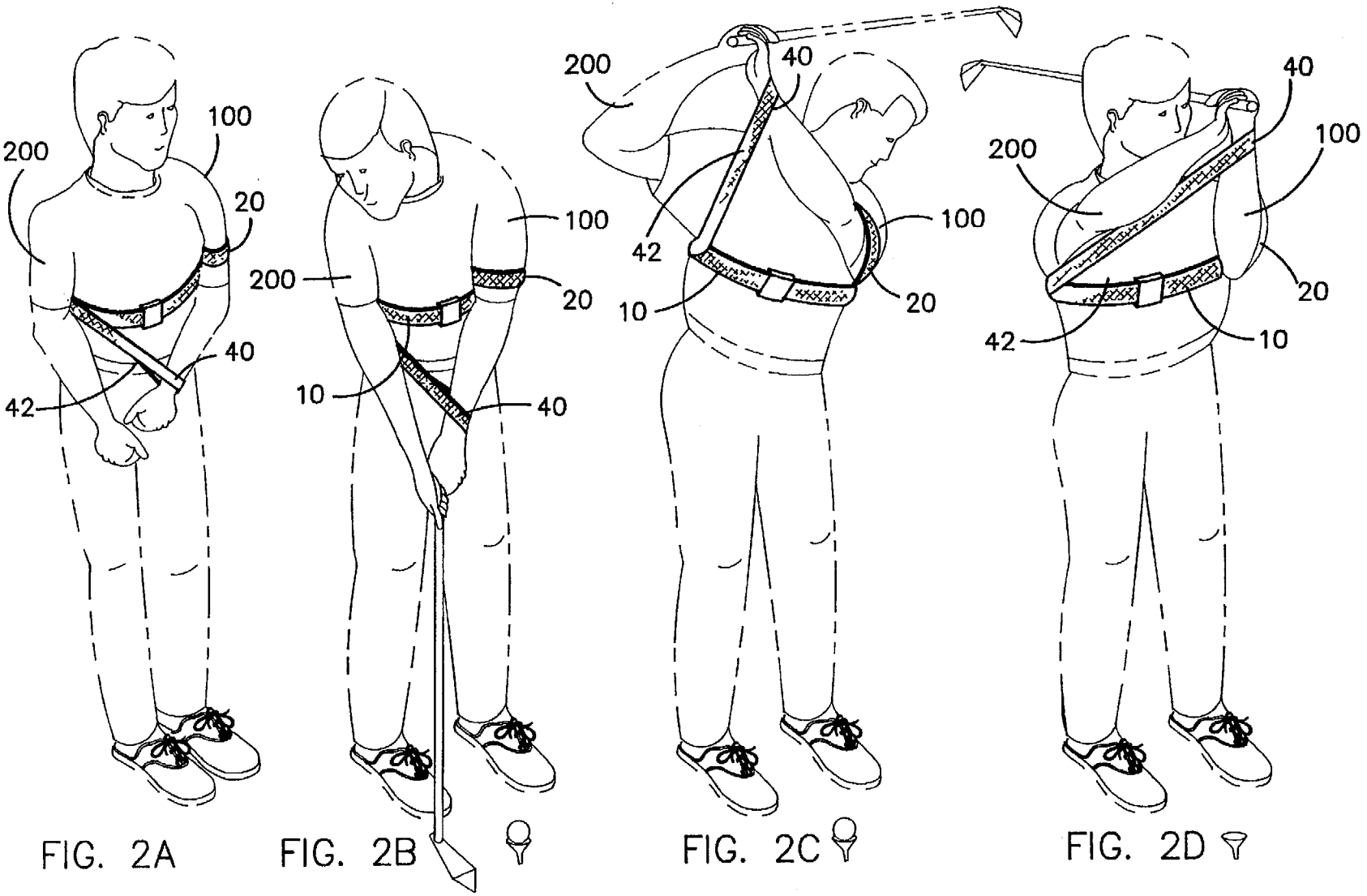
FIG. 2*a* through FIG. 2*d* show the device in use on a right-handed golfer during various stages of a golf swing.

The following description employs an embodiment of the invention having both a biceps tether 30 and a forearm tether 42. Use of this particular embodiment is not intended as a restriction on the scope of the invention. In use, when the chest loop 10 encircles a golfer's chest area, it is preferred that biceps loop 20 be attached to chest loop 10 near the armpit of leading arm. FIG. 2 shows the device in use by a right-handed golfer during various stages of a golf swing. FIG. 2*a* shows the device as worn. Consequently, length of biceps tether 30 should be great enough to have minimal impact on the movement of the leading arm biceps area when the golfer undertakes the back swing. Generally, a length of in the range of 2 to 6 inches should suffice. The forearm tether's 42 length will depend upon where the forearm tether 42 attaches to the chest loop 10. The desired length of the forearm tether 42 in any configuration should be that length which, when the golfer is addressing the ball, leaves little or no slack in the forearm tether 42 as shown in figure. In this fashion, when the golfer begins his back swing, the device will have no or little effect on that back swing. This occurs because neither tether is under substantial tension. FIG. 2*c* shows the device in use during the back-swing portion of a golf swing. However, after contacting the golf ball and beginning the follow through portion of the swing, the device: (1) keeps the leading biceps area in close proximity to the leading side of the golfer's body through the action of the biceps loop 20 and biceps tether 30; and (2) the action of the forearm loop 40 and forearm tether 42 helps guides the leading forearm area through an approximately arc-shaped path which is centered upon the golfer's chest and in the strike plane. FIG. 2*d* shows the device in use during the follow through portion of golf swing. Because the device restricts the leading arm and particularly the leading forearm, but not the trailing arm during the follow through, the device assists in helping the golfer's wrists "turn over" which helps assist in transferring the golfer's weight from his body center to this leading leg. A single biceps loop 20 without the forearm loop 40 would not be as effective in assisting the proper wrist turnover or proper weight shifting.

To assist in tailoring the device to a given golfer, the device may have one or two tether fitting members 50 for adjusting the length of either the forearm tether 42 or biceps tether 30. For instance, a tether fitting member 50 could be a compression type hinged snap 60 attached to the chest loop 10 with the forearm tether 42 threaded through the snap 60. To adjust the forearm tether 42, the snap 60 is opened, the forearm tether 42 positioned in the snap 60 until the desired length is achieved, and the snap 60 is closed, grasping and locking the forearm tether 42 in place. Alternatively, the snap 60 could be attached to the forearm loop 40 instead of the chest loop 10. Clearly, the type of fitting members as previously described for the chest fitting member 11 could also function as a tether fitting member 50.

As indicated above, the device assists the golfer's follow through swing by helping to resist detachment of the elbow of the leading arm and assist in proper wrist turn over and weight shifting. However, the device does not prevent poor or bad shots. With the device in place, a poor back swing or downswing will still result in a poor shot. But because the device assists in the follow through, the golfer can avoid focusing on proper techniques for the follow through and concentrate on improving his back swing and downswing. The device helps isolate the follow through portion of the golf swing and consequently, a golfer can use the device to either: (1) have the device provide muscle memory for a proper follow through (that is, conditioning the body to the "feel" of a proper follow through); or (2) enable the golfer to ignore his follow through and concentrate on improving his back swing and downswing.

There are, of course, many alternate embodiments and modifications of the invention disclosed herein which are intended to be included within the scope of the following claims.

I claim:

1. A method to improve a golfer's swing, the golfer having a leading arm and a trailing arm, the golfer's swing having a back swing portion, a downswing portion, and a follow through portion, said method comprising the steps of (1) providing an apparatus having a chest loop adapted to encircle the chest area of a golfer, a biceps loop connecting to said chest loop and adapted to encircle a golfer's leading arm biceps area, and a forearm loop connecting to said chest loop and adapted to encircle the forearm area of the leading arm of a golfer, said biceps loop and said forearm loop further adapted to co-operate during a golf swing to restrain the elbow of a golfer's leading arm from detaching during the follow through portion of a golf swing, and have substantially no impact on the golfer's leading arm during the back swing and downswing portion of a golf swing, (2) placing said chest loop about said golfer's chest, (3) placing said biceps loop about said golfer's leading arm biceps area and placing said forearm loop about said golfer's leading forearm area, and (4) said golfer performing a golf swing.

2. A method as in claim 1 wherein said chest loop defines a circle having 360 degrees, and said biceps loop and said forearm loop connecting to said chest loop on said circle relative to one another in the range of approximately 90 degrees to approximately 180 degrees apart.

3. A method according to claim 2 wherein said apparatus further has a biceps fitting member for fitting said biceps loop to a variety of biceps area sizes, and wherein step (3) further comprises the steps of fitting said biceps loop to said golfer's leading arm biceps area.

4. A method according to claim 2 wherein said apparatus further has a forearm fitting member for fitting said forearm loop to a variety of forearm area sizes and wherein step (3) further comprises the steps of fitting said forearm loop to said golfer's leading arm forearm area.

5. A method according to claim 2 wherein said biceps loop is adapted to releasably encircle a golfer's leading arm biceps area.

6. A method according to claim 2 wherein said forearm loop is adapted to releasably encircle a golfer's leading arm forearm area.

7. A method as in claim 1 wherein said chest loop defines a circle having 360 degrees, and said biceps loop and said forearm loop connecting to said chest loop on said circle relative to one another at substantially 180 degrees apart.

8. A method as in claim 7 wherein said apparatus further has a forearm tether, said forearm tether connecting said forearm loop and said chest loop.

9. A method as in claim 8 wherein said forearm tether is constructed of an elastic material.

10. A method as in claim 9 wherein said apparatus further has a forearm tether adjustment member for adjusting the length of said forearm tether, and wherein step (3) further comprises the step of adjusting said forearm tether adjustment member so that said forearm tether has no slack when said golfer is addressing a golf ball.

11. A method as in claim 7 wherein said biceps loop is connected to said chest loop by a biceps tether.

12. A method as in claim 11 wherein said biceps tether is constructed of an elastic material.

13. A method as in claim 12 wherein said apparatus further has a biceps tether adjustment member for adjusting the length of said biceps tether, and wherein step (3) further comprises the step of adjusting said biceps tether adjustment member so that said biceps loop has minimal impact upon the golfer's leading arm biceps area during the back swing portion of a golf swing.

14. A method according to claim 7 wherein said biceps loop is constructed of an elastic material.

15. A method according to claim 1 wherein said apparatus further has a chest fitting member for fitting said chest loop to a variety of chest sizes.

16. A method according to claim 15 wherein said chest loop has two ends, and chest fitting member has a first and second members, said first member positioned near one of said ends, said second member positioned near said other of said two ends, said first and said second members positioned near said two ends to be matingly engagable and releasable, and wherein step (2) further comprises the steps of placing said chest loop around said golfer's chest and matingly engaging said first and second members to secure said chest loop about said golfer's chest.

17. A method according to claim 16 wherein said first member is a piece of loop fabric, said second member is a piece of hook fabric.

18. A method according to claim 1 wherein said chest loop is constructed of elastic materials.

* * * * *